US005153317A

United States Patent [19]

Ortega et al.

[11] Patent Number: 5,153,317

[45] Date of Patent: Oct. 6, 1992

[54] COMPOSITION AND METHOD FOR RHEOLOGY CONTROLLED PRINTING OF FABRIC AND CARPET

[75] Inventors: Theresa M. Ortega; Philip E. Winston, Jr., both of San Diego; Kenneth Clare, Vista, all of Calif.

[73] Assignee: Merck & Co., Inc., Rahway, N.J.

[21] Appl. No.: 792,839

[22] Filed: Nov. 15, 1991

Related U.S. Application Data

[63] Continuation of Ser. No. 356,813, May 24, 1989, abandoned.

[51] Int. Cl.[5] ..... C08L 5/04; A23L 1/04

[52] U.S. Cl. ..... 8/543; 8/561; 536/114; 536/123; 536/3; 162/175; 162/176; 162/177; 162/178; 106/162; 106/170; 106/197.2; 106/205; 106/208; 106/209; 106/210

[58] Field of Search ..... 536/3, 114, 123; 106/205, 208, 209, 210, 170, 197.2, 162; 162/175, 176, 177, 178; 8/561, 7, 91

[56] References Cited

U.S. PATENT DOCUMENTS

| | | | |
|---|---|---|---|
| 4,257,768 | 3/1981 | Racciato et al. | 536/114 |
| 4,257,816 | 3/1981 | Yin et al. | 106/205 |
| 4,363,669 | 12/1982 | Cottrell et al. | 106/205 |
| 4,693,728 | 9/1987 | Clare et al. | 106/205 |
| 4,792,415 | 12/1988 | Colegrove | 536/114 |
| 4,859,208 | 8/1989 | Clare et al. | 536/123 |
| 4,894,250 | 1/1990 | Musson et al. | 426/574 |
| 4,911,946 | 3/1990 | Singer et al. | 426/602 |
| 4,952,686 | 8/1990 | Renn et al. | 426/658 |
| 4,979, 989 | 12/1990 | Ridoux | 106/205 |
| 5,079,348 | 1/1992 | Clare | 536/3 |

*Primary Examiner*—Ronald W. Griffin

*Attorney, Agent, or Firm*—Charles M. Caruso; Gabriel Lopez; Richard S. Parr

[57] ABSTRACT

A composition and its method of use are disclosed for controlling rheology of an aqueous dye, which composition comprises 1-30 parts of a gum selected from the group consisting of xanthan gum, rhamsan gum, welan gum and mixtures thereof and 70-99 parts of a water soluble polysaccharide having aliginate equivalent rheology, preferably an alginate. Also disclosed is a color imparting composition for fabric or carpet printing which comprises 99-99% of an aqueous dye component and 1-10% of the rheology control component. The polysaccharide is preferably an alginate, starch, cellulosic polymer or guar gum or mixtures thereof.

19 Claims, No Drawings

COMPOSITION AND METHOD FOR RHEOLOGY CONTROLLED PRINTING OF FABRIC AND CARPET

This is a continuation of application Ser. No. 07/356,813, filed May 24, 1989, now abandoned.

BACKGROUND OF THE INVENTION

The process of textile printing is utilized in a number of different industries, including the production of carpeting as well as fabrics for clothing, bedding and draperies. It is common to divide textile printing in to fabric printing and carpet printing, since while the printing principles are the same, the natures of the two types of textiles causes some variations in procedure.

Fabric printing involves the transfer of colorants (dyes) to fabric (which is defined for the purposes of this invention as relatively smooth flat textiles) and differs from conventional fabric "dyeing." In conventional dyeing processes the object is to impart uniform color throughout the fabric, while in fabric printing the object is to place a recognizable colored design on the fabric or to impart color to only a limited area of the fabric.

Fabric printing involves a number of problems not found in conventional dyeing processes. Every design is formed of discreet lines and limited areas of color which must be clearly defined. Commonly designs involve a plurality of colors, each of which must be clearly separated from the other colors of the design. Thus it is necessary for a printing composition to be able to produce "fine line definition" in which the individual lines of the design are clearly and sharply defined with no significant "bleeding" or "smearing" which would detract from the clarity of the line and the sharpness of the design. The same is true of areas of color, which must have precise boundaries and, in "wet-on-wet" printing processes, not allow one color to bleed into a neighboring color.

Also of importance is the degree of fabric penetration of an individual colorant. While with conventional dyeing it is desirable to have the color penetrate completely through the fabric so that both sides of a fabric are equally and thoroughly colored, with fabric printing the opposite is true. Normally in fabric printing the fabric designer wishes to limit the printing to one side of the fabric so that the printed designs either do not appear at all when the fabric is viewed from the opposite side (as in carpeting and some clothing) or that the visibility of the design is distinctly subdued when viewed from the opposite side of the fabric (as in some bedding). However, it is of course still important that the printed design penetrate or adhere sufficiently to the application side of the fabric such that normal wearing, washing and other intended uses of the fabric will not significantly degrade the quality and appearance of the design.

Carpet printing is basically similar, but since carpet is (for the purposes of this invention) considered to be a relatively thick textile with a clearly defined pile, some practical aspects of the printing are different from those of fabric printing. Principally, it is important in carpet printing to insure that the colorant penetrates into the pile down to the base of the carpet without spreading laterally; i.e., that it retains the pattern or color area definition. It must also have a higher degree of rheologic and heat stability so that the dye does not run off the tops of the pile fibers when the dyes are fixed on the carpet by conventional steaming.

The colorant compositions may be applied by a variety of different devices, depending on the particular industry and type of fabric involved. Commonly one uses rotary printing presses, in which a colorant paste is forced through a porous pattern in contact with the fabric, in a manner analogous to silk screen printing, for the flat fabrics. Carpet printing is often done with devices such as jet printing machines in which the colorant composition is projected in a narrowly defined jet against the fabric and the printing head follows a predefined path to "draw" the design on the carpet and cause the dye to penetrate into the pile. The jet printers themselves may be of two different types; in one type the stream of colorant forming the jet runs continuously and the stream is diverted mechanically or pneumatically from the fabric into a recycle path as the printing head traverses portions of the fabric where no design is desired, while in the other the colorant jet is turned on as the head passes the areas of the fabric where the design is to be imparted and turned off while the jet traverses areas of the fabric where no design is to be placed.

The dyes themselves can be of different compositions. One principal class of dyes widely used is the "reactive" dyes, which are dye compounds which react chemically with the fibers of the fabric, thus forming a permanent color pattern, and which are preferentially used with natural fiber textiles. Another common class is the acid dyes, used principally with synthetic fiber textiles.

It will be evident from the above consideration that rheology control of colorant compositions is of utmost significance, in order to allow the colorant compositions to be utilized in a variety of different application devices and to yield fabric and carpet designs which are colorfast, sharply defined and have the requisite degree of penetration.

In the past, however, only a few types of colorant composition exhibited a wide range of these properties. It was often found that rheology control components incorporated into colorant compositons were usable only in certain types of printing apparatus or with certain types of textiles or in combination with limited numbers of dyes. Further, when a control component had relatively short flow properties and fast shear recovery rate, it would not provide adequate leveling of the compositon, while another component with relatively long flow properties and slow shear recovery rate would lead to poor line definition and was difficult to use in "on/off" types of jet printing devices. Also, some control components are also excessively reactive with the dye compounds themselves, such that when the colorant composition is applied to the textile a portion of the dye reacts preferentially with the rheology control component rather than with the fabric, so that when the fabric is later washed that portion of the dye is removed from the textile leaving a significantly degraded design and wasting substantial amounts of dye. Since the dye is commonly the most expensive part of any colorant composition, this not only results in a poorly printed product but also is quite uneconomical.

It would therefore be of significant value to have rheology control agents which can be incorporated into fabric and carpet printing compositions and which will allow for fine line definition, essentially full color transfer to the textile and versatility of use in a variety of different printing devices. It is an object of this invention to provide such rheology control agents and colorant compositions incorporating such agents which are useful in a wide variety of fabric and carpet printing applications.

BRIEF SUMMARY OF THE INVENTION

In one aspect the invention herein resides in a composition for controlling rheology of an aqueous dye which composition comprises 1-30 parts, preferably 2-25 parts, and more preferably 5-20 parts, of a gum selected from the group consisting of xanthan gum, rhamsan gum, welan gum and mixtures thereof and 70-99 parts, preferably 75-98 parts, and more preferably 80-95 parts, of a water soluble polysaccharide having alginate equivalent rheology, preferably an alginate. (All percentages and parts defined herein are by weight unless stated to be otherwise.)

In another aspect the invention resides in a color imparting composition for fabric printing which comprises 90-99% of an aqueous dye component and 1-10% of a rheology control component, the rheology control component comprising 1-30 parts, preferably 2-20 parts, and more preferably 5-15 parts, of a gum selected from the group consisting of xanthan gum, rhamsan gum, welan gum and mixtures thereof and 70-99 parts, preferably 80-98 parts, and more preferably 80-95 parts, of a water soluble polysaccharide having alginate equivalent rheology, preferably an alginate.

In yet another aspect the invention resides in a color imparting composition for carpet printing which comprises 90-99% of an aqueous dye component and 1-10% of a rheology control component, the rheology control component comprising 1-30 parts, preferably 5-30 parts, and more preferably 8-20 parts, of a gum selected from the group consisting of xanthan gum, rhamsan gum, welan gum and mixtures thereof and 70-99 parts, preferably 70-95 parts, and more preferably 80-92 parts, of a water soluble polysaccharide having alginate equivalent rheology, preferably an alginate.

In yet another aspect the invention resides in a method of controlling the rheology of an aqueous dye composition which comprises incorporating into the composition 1-10% of a rheology control component which comprises 1-30 parts, preferably 2-25 parts, and more preferably 5-20 parts, of a gum selected from the group consisting of xanthan gum, rhamsan gum, welan gum and mixtures thereof and 70-99 parts, preferably 75-98 parts, and more preferably 80-95 parts, of a water soluble polysaccharide having alginate equivalent rheology, preferably an alginate.

DETAILED DESCRIPTION

The rheology control agents of the present invention, and the novel and versatile colorant compositions which they produce, are based on the unexpected discovery that combinations of components which are themselves individually of limited utility or even not useful as colorant component rheology control agents are when combined in specific proportions able to form highly effective rheology control agents for a wide variety of colorant compositions useful in many different applications and with different types of printing equipment.

The first component of the compositions herein is a gum selected from the group consisting of xanthan gum, rhamsan gum, welan gum or mixtures thereof.

By the term "xanthan gum" as used herein is meant the extracellularly produced gum made by the heteropolysaccharide-producing bacterium *Xanthomonas campestris* by the whole culture fermentation of a variety of conditions of a medium comprising a fermentable carbohydrate, a nitrogen source and other appropriate nutrients. Examples of commercially available xanthan gum are "KELTROL® T", "KELTROL® F", "KELZAN® AR" and "KELZAN®", available from Kelco Division of Merck & Co., Inc.

Processes for producing xanthan gum are well known in the art and are described in a number of patents including U.S. Pat. Nos. 4,316,012, 4,352,882, 4,375,512, 3,671,398, 3,433,708, 3,271,267, 3,594,280, 3,591,578, 3,391,061, 3,020,206, 3,481,899 and 3,391,060 as well as British Patent No. 1,448,645.

A preferred form of xanthan gum utilized in the invention is that which has been clarified by any of several known clarification processes. Clarified xanthan gum such as "KELTROL® T" and "K5B143" (products of Kelco Division of Merck and Company, Inc.) is commercially available. As defined herein clarified xanthan gum is that which has a 1% (wt./vol.) solution (deionized water) transmittance of not less than 85%, measured on a Bausch & Lomb "SPECTRONIC" photometer, model 21 (600 mm., 25° C., 10 mm. cell).

Also useful in this invention is welan gum. Welan gum is a water-soluble polysaccharide produced by the fermentation of Alcaligenes spp. Welan gum is stable over a wide range of viscosities and at temperatures up to about 150° C. (300° F.). Welan gum is described in U.S. Pat. No. 4,342,866. A typical welan gum is that available commercially under the trade designation "K1A96" from Kelco Division of Merck & Co., Inc.

The third gum useful in the present invention is rhamsan gum. Rhamsan gum is a microbial polysaccharide also produced from Alcaligenes spp. which is highly pseudoplastic, has a stable viscosity over a range of pH of 2-12 and at temperatures up to about 100° C. (212° F.) and is compatible with high concentrations of salt. Rhamsan gum is described in U.S. Pat. No. 4,401,760. Rhamsan gum is commercially available; a typical example is a gum sold under the trade designation "K1A112" by Kelco Division of Merck & Co., Inc.

The viscosity of the gum to be used will be a simple matter of selection based on the nature of the colorant composition system into which the rheology control agent is to be incorporated.

The other principal component of the compositions of this invention is a water-soluble polysaccharide having "alginate equivalent rheology." By this term is meant a polysaccharide whose rheologic properties in these compositions is substantially equivalent to the rheologic properties which would be exhibited by an alginate. The preferred polysaccharides are the alginates themselves, because they are the only relevant class of polysaccharides which are useful with all of the applicable dyes, i.e., are the only class of polysaccharides which do not react with the reactive dyes. Other polysaccharides within the class of "alginate equivalent rheology" materials are, however, useful with other dyes, especially the acid dyes, and are therefore within the scope of this invention. Suitable polysaccharides include alginates (as noted), starches, cellulosic ethers, guar gum and mixtures thereof.

There are a wide variety of alginates useful in this invention. These are described in detail by I. W. Cottrell and P. Kovacs in "Alginates," as Chapter 2 of Davidson, ed., *Handbook of Water-Soluble Gums and Resins* (1980). Most preferred herein are the sodium alginates, such as those sold commercially under the trademarks KELTEX® and KELGIN® by Kelco Division of Merck & Co., Inc.

The cellulosic ethers, guar gum and starches are also widely described in the literature. The Davidson text, supra, has typical disclosures of these materials: see J. K. Seaman, "Guar Gum," Chapter 6; G. M. Powell, "Hydroxyethylcellulose," Chapter 12; and M. W. Rutenberg, "Starch and its Modifications," Chapter 22.

In the present invention the polysaccharide and gum will be present in a weight ratio in the range of 99–70 parts of polysaccharide to 1–30 parts of gum. Preferably the ratio will be in the range of 98–75 parts of polysaccharide to 2–25 parts of gum, and more preferably in the range of 95–80 parts of polysaccharide to 5–20 parts of gum. The entire polysaccharide/gum rheology control component will be present as from 1–10%. preferably 2–8%, of the print paste composition. As will be discussed below, the specific preferred ranges will vary slightly depending on whether fabric printing or carpet printing is involved.

The particular dyes used in the colorant compositions of this invention will be chosen on the basis of the type of fabric to be colored and compatibility with the remaining components of the print paste composition. There are many types of dyes useful for textile printing; various classes of dyes are described in Kulkarni et al., *Textile Dyeing Operations* (1986) and in Venkataraman, *The Chemistry of Synthetic Dyes*, vols. IV and VIII (1972). Most preferred for the print pastes of this invention are the reactive dyes, which derive their name from the fact that they react covalently with many major natural textile fibers, including wool, the cellulosic fibers and silk. The reactive dyes include colored acid chlorides, vinyl sulfones and the vinyl sulfone and triazine derivatives of anthraquinones, including the mono- and dichlorotriazinyl compounds. The reactive dyes are described in detail in Kulkarni et al., supra, Section 6.7 and in Venkataraman, supra, vol. VI. Another preferred class of the dyes is the acid dyes, which are so named because they are normally applied in organic or inorganic acid dyeing solutions. These dyes generally are anionic dyes with relatively low molecular weight which contain one to three sulfonic acid groups and are used as salts, such as sodium salts. The majority of the acid dyes are azo, anthraquinone and triarylmethane dyes. They are described in detail in Kulkarni et al., supra, Section 6.2. They find particular application with the synthetic fibers such as nylon. The particular dye of choice for any specific application may be readily selected by one skilled in the art by routine procedures. The dye will normally be present as about 2–4% of the colorant composition.

The colorant compositions also commonly contain small amounts of additional materials as dispersants, stabilizers, dye solubilizers and so forth. The rheology control component herein preferably contains sodium hexametaphosphate (sold commercially under the trademark CALGON® by Calgon Corporation) as a sequestrant for calcium in the water present in the composition, to prevent unwanted gellation of the gum or polysaccharide. The amount of the sodium hexametaphosphate present will be on the order of about 20–30% of the polysaccharide. Other sequestrants include salts of ethylenediaminetetraacetic acid (EDTA) and sodium citrate. In addition, the composition can contain materials such as m-nitrobenzene sulfonate (sold commercially under the trademark LUDIGOL®) as an anti-reductive agent for the dye in an amount of about 1.0–1.5% of the composition, urea (10–12% of the composition) and sodium bicarbonate (about 2% of the composition.)

As noted above, the particular needs of fabric printing and carpet printing lead to slightly different preferred ranges of components in the rheology control agents of this invention. For fabric printing the rheology control component will preferably comprise 2–20 parts, more preferably 5–15 parts, of gum and 80–98 parts, more preferably 80–95 parts, of the water soluble polysaccharide. For carpet printing the rheology control component will preferably comprise 5–30 parts, more preferably 8–20 parts, of gum and 70–95 parts, more preferably 80–92 parts, of the water soluble polysaccharide.

It is believed that the compositions herein are effective because under the conditions of use the gum is more pseudoplastic than the polysaccharide (i.e., it has a higher viscosity at a given temperature). This in turn imparts a greater rheologic stability to the composition than would be obtained with the polysaccharide alone. The dye compositions are usually applied at ambient temperature. However, the dyes are then fixed on the fabric or carpet by steaming (usually at about 220° F./105° C. for about ten minutes). Under these latter conditions, the composition remains properly in position on the textile so that the dye color does not migrate from the tops of the fibers.

Colorant compositions incorporating the rheology control agents of this invention were tested in a variety of fabric printing laboratory processes which accurately simulate the effects to be obtained in commercial processes. In a first set of experiments pressure printing effects were measured, using a production-size commercial rotary screen print machine. Cotton fabric having a weight of 166 g/m$^2$ was printed with an 80 mesh screen using several different test compositions and an alginate thickener as a control. Pressure of the squeegee on the rotary screen was adjusted for each run to obtain equal pick-up of each test print paste as compared to the control. In addition to the thickener and the dye, the compositions also included water and small conventional amounts of sodium hexametaphosphate, m-nitrobenzene sulfonate and sodium bicarbonate. The dye used was a Prussian blue commercial reactive dye (from Imperial Chemical Industries). Following application of print paste in each run, the printed fabrics were dried and then fixed with steam fixation for seven minutes at 105° C. followed by hand washing to remove excess print paste and then dried prior to print evaluation.

In Tables I and II below the data labeled "dE" represent the measure of color differences for the test samples as compared to a standard, based on tristimulus values, according to AATCC Test Method 153-1985 (*AATCC Technical Manual*/1987, page 272). A higher value indicates greater color acquisition by the textile. The data labeled "dL" represent the measure of difference of darkness of the pattern imparted to the textile, and is determined by subtracting the "da" and "db" color components of "dE" (see AATCC Test Method 153-1985) from the "dE" value for each sample. A negative value means that the test sample was darker than the standard; i.e., that it had more dye imparted to it. Viscosities reported for the compositions were measured with a Brookfield "RVT" viscometer operating at 20 rpm at 20° C. with a No. 2 spindle. The comparative designations stated are "sup." for "superior," "eq." for "equal" and "inf." for "inferior". An "S." preceding a designation indicates "slightly."

ing machines of both the air diversion jet type and the off/on jet type. Rheology control components similar to those reported above were formed of alginate and xanthan gum in ratios of 90:10 and 85:15 and run in series with control materials having only alginate as the thickener. The rheology control components also contained small amounts of sodium hexametaphosphate to provide ionic stability in the presence of the acidic dye in the colorant composition. In addition the runs were compared against prior art colorants used in the jet printing devices in which the thickener is a starch. In all cases notable improvement in rheologic control resulting in improved print definition and color was observed.

TABLE I

| | RUN | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| Thickener: | | | | | | | | | | | | | |
| Alginate | 100 | 90 | 90 | 90 | 90 | 85 | 85 | 85 | 85 | 86 | 86 | 86 | 86 |
| Rhansan Gum | — | 10 | 10 | 10 | 10 | 15 | 15 | 15 | 15 | — | — | — | — |
| Xanthan Gum | — | — | — | — | — | — | — | — | — | 14 | 14 | 14 | 14 |
| Paste | | | | | | | | | | | | | |
| Thickener, % | 2.3 | 2.3 | 2.3 | 2.3 | 2.3 | 2.0 | 2.0 | 2.0 | 2.0 | 2.3 | 2.3 | 2.3 | 2.3 |
| Dye, % | 3.0 | 3.0 | 3.0 | 3.0 | 3.0 | 3.0 | 3.0 | 3.0 | 3.0 | 3.0 | 3.0 | 3.0 | 3.0 |
| Printing Results | | | | | | | | | | | | | |
| Pickup, % | 95 | 82 | 85 | 95 | 100 | 85 | 87 | 85 | 95 | 90 | 95 | 85 | 95 |
| Viscosity, cP | 14530 | 16440 | 16440 | 16440 | 16440 | 12661 | 12661 | 12661 | 12661 | 11338 | 11338 | 13303 | 13303 |
| Penetration | Control | Sup. | Sup. | S. Sup. | S. Sup. | S. Sup. | S. Sup. | S. Sup. | S. Sup. | S. Sup. | S. Sup. | S. Sup. | . Sup. |
| Levelness | Control | S. Inf. | Eq. | Eq. | S. Sup. | Eq. | S. Sup. | S. Sup. | Eq. | S. Sup. | Eq. | S. Sup. | S. Sup. |
| Definition | Control | Eq. | S. Sup. | S. Sup. | Eq. | S. Inf. | S. Sup. | S. Sup. | S. Sup. | S. Sup. | S. Sup. | S. Sup. | S. Sup. |
| Handle | Control | Eq. | Eq. | Eq. | Eq. | Eq. | Eq. | Eq. | Eq. | Eq. | Eq. | Eq. | Eq. |
| Applied Dye | 2.85 | 2.46 | 2.55 | 2.85 | 3.00 | 2.55 | 2.61 | 2.55 | 2.85 | 2.70 | 2.85 | 2.55 | 2.85 |
| Equivalent Dye Cont., % | Control | +5 | −10 | −10 | −15 | +15 | Eq. | Eq. | −15 | Eq. | −20 | Eq. | −10 |
| Equivalent Applied Dye | 2.85 | 2.71 | 3.14 | 3.14 | 3.28 | 2.42 | 2.85 | 2.85 | 3.28 | 2.85 | 3.42 | 2.85 | 3.14 |
| Color value | | | | | | | | | | | | | |
| change, % | Control | +10.2 | +23.1 | +10.2 | +9.3 | −5.1 | +9.2 | +11.8 | +15.1 | +5.6 | +20.0 | +11.8 | +10.2 |
| dL | −61.0 | −60.7 | −63.2 | −61.0 | −61.8 | −58.4 | −60.2 | −60.8 | −62.8 | −62.0 | −64.1 | −61.7 | −63.0 |
| dE | 72.2 | 74.3 | 75.6 | 70.9 | 70.8 | 71.3 | 71.4 | 72.0 | 73.7 | 74.8 | 77.2 | 74.6 | 74.6 |

TABLE II

| | RUN | | | | | | | | | | |
|---|---|---|---|---|---|---|---|---|---|---|---|
| | 14 | 15 | 16 | 17 | 18 | 19 | 20 | 21 | 22 | 23 | 24 |
| Thickener: | | | | | | | | | | | |
| Alginate | 100 | 100 | 85 | 85 | 85 | 85 | 85 | 85 | 85 | 85 | 85 |
| Rhansan Gum | — | — | — | — | 15 | — | 15 | — | — | — | 15 |
| Xanthan Gum | — | — | 15 | 15 | — | 15 | — | 15 | 15 | 15 | — |
| Paste | | | | | | | | | | | |
| Thickener, % | 1.88 | 2.16 | 1.78 | 1.78 | 1.55 | 2.06 | 1.82 | 2.20 | 1.96 | 2.45 | 2.18 |
| Dye, % | 2.00 | 2.00 | 2.00 | 2.00 | 2.00 | 2.00 | 2.00 | 2.00 | 2.00 | 2.00 | 2.00 |
| Printing | | | | | | | | | | | |
| Viscosity, cP | 5430 | 7685 | 6516 | 4761 | 5346 | 8134 | 8299 | 7894 | 10622 | 15561 | 14215 |
| Penetration | Control | Eq. | Eq. | Eq. | Eq. | Eq. | Eq. | Sup. | S. Sup. | S. Sup. | S. Sup. |
| Levelness | Control | S. Inf. | Eq. | S. Inf. | S. Inf. | S. Inf. | S. Inf. | Eq. | S. Inf. | S. Inf. | S. Inf. |
| Definition | Control | Eq. | Eq. | Eq. | Eq. | Eq. | Eq. | Eq. | Eq. | Eq. | Eq. |
| Handle | Control | Eq. | Eq. | Eq. | Eq. | Eq. | Eq. | Eq. | Eq. | Eq. | Eq. |
| Rub-fastness | | | | | | | | | | | |
| Dry | 4–5 | 4 | 4 | 3–4 | 4 | 4 | 3–4 | 4 | 4 | 4–5 | 4–5 |
| Wet | 3–4 | 4 | 4 | 3–4 | 3–4 | 4 | 4 | 4 | 4 | 4 | 4 |
| Equivalent Dye Conc., % | Control | −10 | +20 | −10 | −10 | −10 | −25 | +5 | −10 | −20 | −30 |

It will be evident from these data that the blends of this invention provide a printed fabric which has penetration, levelness and definition properties which are as good as or better than the properties of the alginate thickened control. In addition the handle of the printed fabric is equal to that of fabrics printed with the control. Most importantly, however, the data show a substantially consistent improvement in the equivalent dye and color values imparted to the fabrics. This provides two alternate and substantial benefits: for the same amount of dye used an improved and increased color value can be imparted to the fabric or, alternatively, the same degree of color value can be imparted to the fabric by using significantly less dye in the print paste. Also of particular importance is the superior control of print paste penetration that the compositions of this invention uniformly provide.

The compositions of the present invention were also run in experimental carpet printing tests using jet print- It has previously been recognized that the use of cationic dyes in print pastes which also contain xanthan gum can cause unacceptable precipitation or gelation of the xanthan gum. Additions of small amounts of surfactants to the blends for the experimental runs, as outlined by the prior art, were sufficient to eliminate such precipitation or gelation.

In this series of runs the products shown in Table III below were tested in a jet printer to lay out plaid, floral, geometric and block patterns on carpeting.

TABLE III

| | RUN: | | | | |
|---|---|---|---|---|---|
| | 25 | 26 | 27 | 28 | 29 |
| Alginate | 100 | 85 | 85 | 85 | 70 |
| Xanthan Gum | — | 15 | 15 | 15 | 30 |
| Concentration, % | 2.0 | 0.65 | 0.75 | 0.60 | 0.75 |

Tailing of the colorant composition was more likely when the ratio of alginate to gum was near 70:30; as the proportion of alginate increased, the occurrence of tailing decreased. Best results were obtained when the ratio was approximately 85:15.

It will be evident that there are many embodiments of this invention which, while not expressly set forth above, are clearly within the scope and spirit of the invention. The above description is therefore to be considered exemplary only, and the scope of the invention is to be limited only by the appended claims.

What is claimed is:

1. A composition for controlling rheology of an aqueous dye which comprises (A) 1–30 parts of a gum selected from the group consisting of xanthan gum, rhamsan gum, welan gum and mixtures thereof, and (B) 70–99 Parts of a water soluble polysaccharide component have alginate equivalent rheology, wherein (B) comprises 70–99 parts of a water soluble polysaccharide selected from the group consisting of alginates, starches, cellulosic polymers, guar gum and mixtures thereof, provided that the mixture does not simultaneously include alginates and starches or alginates and cellulosic polymers, provided that when (A) is xanthan gum (B) is not alginate, and when (A) is xanthan gum and (B) is guar, the composition comprises at least 25 parts (A) and at most 75 parts guar.

2. A composition as in claim 1 comprising 2–20 parts of said gum and 80–98 parts of said water soluble polysaccharide.

3. A composition as in claim 2 comprising 5–15 parts of said gum and 80–95 parts of said water soluble polysaccharide.

4. A composition as in claim 1 comprising 5–30 parts of said gum and 70–95 parts of said water soluble polysaccharide.

5. A composition as in claim 4 comprising 8–20 parts of said gum and 80–92 parts of said water soluble polysaccharide.

6. A composition as in claim 1 wherein (B) is selected from the group consisting of alginates, starches, cellulosic polymers, and guar gum.

7. A composition as in claim 6 wherein (B) is an alginate.

8. A color imparting composition which comprises 90–99 percent of an aqueous dye and 1–10% of a rheology control component, said rheology control component comprising 1–30 parts of a gum selected from the group consisting of xanthan gum, rhamsan gum, welan gum and mixtures thereof and 70–99 parts of a water soluble polysaccharide having alginate equivalent rheology except that when said polysaccharide is an alginate, said gum cannot be xanthan.

9. A composition as in claim 8 wherein said rheology control component comprises 2–20 parts of said gum and 80–98 parts of said water soluble polysaccharide.

10. A composition as in claim 9 wherein said rheology control component comprises 5–15 parts of said gum and 80–95 parts of said water soluble polysaccharide.

11. A composition as in claim 8 wherein said rheology control component comprises 5–30 parts of said gum and 70–95 parts of said water soluble polysaccharide.

12. A composition as in claim 11 wherein said rheology control component comprises 8–20 parts of said gum and 80–92 parts of said water soluble polysaccharide.

13. A composition as in claim 8 wherein said polysaccharide is selected from the group consisting of alginates, starches, cellulosic polymers, guar gum and mixtures thereof.

14. A composition as in claim 13 wherein said polysaccharide is an alginate.

15. A composition as in claim 8 wherein said aqueous dye is a reactive dye.

16. A composition as in claim 8 wherein said aqueous dye is an acid dye.

17. A method of controlling the rheology of an aqueous dye composition which comprises incorporating into said composition 1–10% of a rheology control component which comprises 1–30 parts of a gum selected from the group consisting of xanthan gum, rhamsan gum, welan gum and mixtures thereof and 70–99 parts of a water soluble polysaccharide having alginate equivalent rheology.

18. A method as in claim 17 wherein said polysaccharide is selected from the group consisting of alginates, starches, cellulosic polymers, guar gum and mixtures thereof.

19. A method as in claim 18 wherein said polysaccharide is an alginate.

* * * * *